US012735768B2

(12) United States Patent
Chang et al.

(10) Patent No.: US 12,735,768 B2
(45) Date of Patent: Sep. 15, 2026

(54) METHOD FOR RECOVERING NOBLE METALS FROM CATALYTIC CONVERTER

(71) Applicant: National Ilan University, Yilan City (TW)

(72) Inventors: Chang-Tang Chang, Yilan City (TW); Yi-Ta Wang, Yilan City (TW); Lian-Wei Li, Yilan City (TW)

(73) Assignee: NATIONAL ILAN UNIVERSITY, Yilan City (TW)

( * ) Notice: Subject to any disclaimer, the term of this patent is extended or adjusted under 35 U.S.C. 154(b) by 469 days.

(21) Appl. No.: 18/398,196

(22) Filed: Dec. 28, 2023

(65) Prior Publication Data

US 2025/0215526 A1 Jul. 3, 2025

(51) Int. Cl.

| | |
|---|---|
| ***C22B 11/00*** | (2006.01) |
| ***C22B 1/02*** | (2006.01) |
| ***C22B 1/248*** | (2006.01) |
| ***C22B 7/00*** | (2006.01) |

(52) U.S. Cl.

CPC ..... *C22B 11/048* (2013.01); *C22B 1/02* (2013.01); *C22B 1/248* (2013.01); *C22B 7/008* (2013.01)

(58) Field of Classification Search

CPC ..... C22B 11/048; C22B 1/02; C22B 1/248; C22B 7/008

See application file for complete search history.

(56) References Cited

U.S. PATENT DOCUMENTS

2013/0276284 A1* 10/2013 Brosseau ..... H05K 3/22 29/426.1

* cited by examiner

*Primary Examiner* — Stuart L Hendrickson

(74) *Attorney, Agent, or Firm* — Che-Yang Chen

(57) ABSTRACT

A method for recovering noble metals from a catalytic converter comprises the following steps: (a) obtaining a catalytic converter, wherein the components of the catalytic converter comprise noble metals and base metals; (b) carrying out high-temperature treatment on the catalytic converter to remove carbon-containing substances in the catalytic converter; (c) breaking the catalytic converter to obtain powder to be treated; (d) dissolving noble metals and base metals in liquid; (e) reacting and depositing the liquid to obtain a gold-containing precipitate; (f) reacting and depositing the filtrate (I) to obtain a platinum-containing precipitate; (g) reacting and depositing the filtrate (II) to obtain a base-metal-containing precipitate; (h) reacting and depositing the filtrate (III) to obtain a palladium-containing precipitate; and (i) reacting and depositing the filtrate (IV) to obtain rhodium-containing metal precipitate. Steps (e) to (i) are performed in sequence.

9 Claims, 5 Drawing Sheets

METHOD FOR RECOVERING NOBLE METALS FROM CATALYTIC CONVERTER

BACKGROUND OF THE PRESENT INVENTION

Field of Invention

The invention relates to a metal recovery method, in particular to a method for recovering noble metals from metal waste.

Description of Related Arts

Metal waste is one of the primary types of waste. Such waste contains numerous metal components or materials, which have significant potential for recycling and are worth further development and application. In regard to catalytic metal waste, the industry has made substantial efforts to develop related recovery technologies to reclaim the metal from the metal waste for use as a catalyst.

Most research focuses on separating and purifying metal components from metal wastes using dry smelting or wet smelting technologies. Subsequently, the recovered metals are employed to manufacture other reusable products. However, the aforementioned methods often require substantial consumption of chemical raw materials or electrical energy, and the separated and recovered metals may still have issues like inadequate purity or the presence of other impurities. Few literatures discuss the direct recovery of metal waste into catalyst and its application on pollution prevention study.

Thus, there is a need to enhance the recovery method for noble metals to address the aforementioned technical problems.

SUMMARY OF THE PRESENT INVENTION

In the light of this, the embodiment of the invention discloses a method for noble metal recovery to overcome the limitations of the prior art.

According to an embodiment of the invention, a method for recovering noble metals from a catalytic converter is disclosed, which comprises the following steps: (a) obtaining a catalytic converter, wherein the components of the catalytic converter comprise noble metals and base metals; (b) performing a high-temperature treatment on the catalytic converter to remove carbon-containing substances in the catalytic converter; (c) breaking the catalytic converter to obtain powder to be treated; (d) performing a liquid phase extraction on the powder to be treated, so as to dissolve the noble metals and the base metals in the liquid; (e) reacting and depositing the liquid to obtain a gold-containing precipitate, wherein the step (e) comprises performing the following steps in sequence: (e-1) adding metal hydroxide into the liquid to adjust the pH value of the liquid to 1-2; (e-2) adding sodium sulfite into the liquid; (e-3) standing the liquid to form the gold-containing precipitate; and (e-4) filtering the liquid to obtain a filtrate (I); (f) reacting and depositing the filtrate (I) to obtain a platinum-containing precipitate, wherein the step (f) comprises the following steps in sequence: (f-1) adding hydrogen peroxide into the filtrate (I); (f-2) adding potassium chloride into the filtrate (I); (f-3) standing the filtrate (I) to form a platinum-containing precipitate; and (f-4) filtering the filtrate (I) to obtain a filtrate (II); (g) reacting and depositing the filtrate (II) to obtain a base-metal-containing precipitate, wherein the step (g) comprises the following step in sequence: (g-1) adding $NH_4OH$ into the filtrate (II) to adjust the pH value of the filtrate (II) to 11; (g-2) standing the filtrate (II) to form a base-metal-containing precipitate; and (g-3) filtering the filtrate (II) to obtain a filtrate (iii); (h) reacting and depositing the filtrate (III) to obtain a palladium-containing metal precipitate, wherein the step (h) comprises performing the following steps in sequence: (h-1) adding HCl into the filtrate (III) to adjust the pH value of the filtrate (III) to less than 2; (h-2) standing the filtrate (III) to form a palladium-containing precipitate; and (h-3) filtering the filtrate (III) to obtain a filtrate (IV); and (i) reacting and depositing the filtrate (IV) to obtain a rhodium-containing metal precipitate, wherein the step (i) comprises performing the following steps in sequence: (i-1) repeatedly flowing the filtrate (IV) through Zn powder; (i-2) standing the filtrate (IV) to form a rhodium-containing precipitate; and (i-3) filtering the filtrate (IV) to obtain a filtrate (V), wherein the steps (e) to (i) are performed in sequence.

BRIEF DESCRIPTION OF THE DRAWINGS

In order to more clearly and comprehensively present the objectives, features, advantages, and embodiments of the present invention, descriptions of the attached drawings are provided as follows.

DETAILED DESCRIPTION OF THE PREFERRED EMBODIMENT

Figure 1:
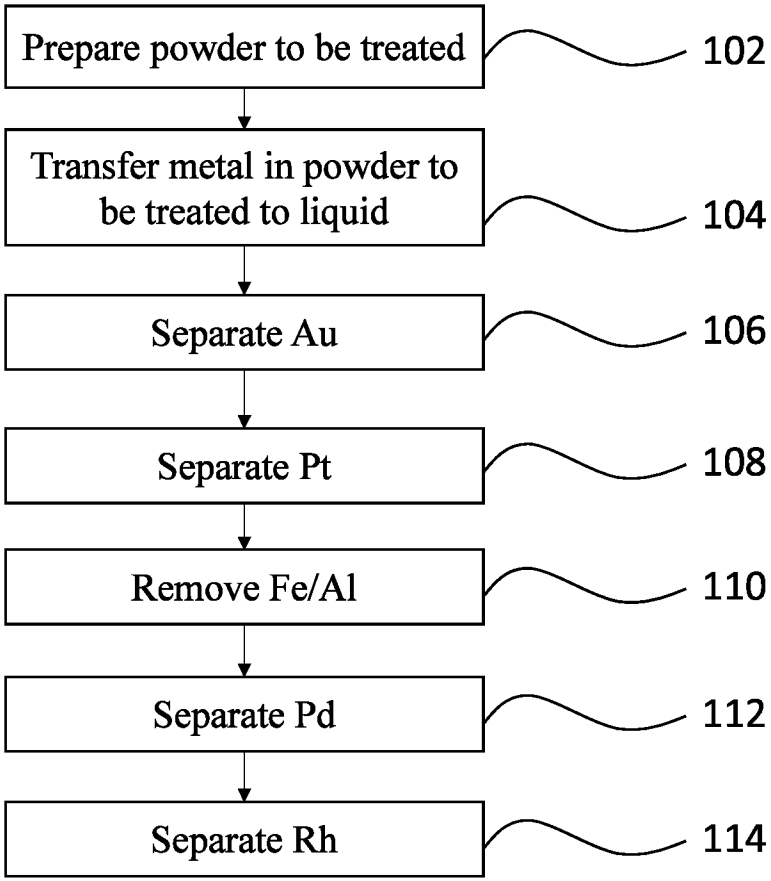
FIG. 1 is a flowchart illustrating a method for recovering noble metals from a catalytic converter, according to one embodiment of the present invention.

The detailed features and advantages of the present invention are elaborated upon in the subsequent embodiments. The content is sufficient for individuals well-versed in the related art to comprehend and implement the technical content of the present invention. Based on the contents disclosed in this specification, the claims, and the accompanying drawings, those familiar with the related art can readily understand the objectives and benefits of the present invention. The following examples are used to further describe aspects of the present invention but are not intended to restrict its scope in any manner.

Although the numerical ranges and parameters used to define the broad scope of the invention are approximate values, the specific figures within the embodiment are presented with as much accuracy as possible. Any numerical value, however, inherently contains variations due to individual testing methodologies. Herein, "about" typically indicates that the actual value lies within beyond or below 10%, 5%, 1%, or 0.5% of a specified value or range. Alternatively, "about" implies that the actual value resides within the acceptable standard error of the mean, as deemed by those having ordinary skill in the art. Except in experimental examples or unless otherwise noted, all numerical terms herein (e.g., material quantities, durations, temperatures, conditions, ratios, etc.) should be understood as modified by "about". Therefore, unless indicated otherwise, the numerical parameters disclosed in the specification and the attached claims are approximations and can be adjusted as necessary. These figures should, at least, be interpreted in terms of their significant digits and rounded using standard conventions. Herein, numerical ranges are denoted as spanning from one endpoint to another or as lying between two endpoints, and unless specified otherwise, these endpoints are inclusive in the numerical ranges.

Unless explicitly defined in this specification, scientific and technical terms employed herein are the same meanings consistent with those understood by one having ordinary skill in the art. Moreover, unless it conflicts with the context, singular nouns used in the specification encompass their plural forms, and vice versa for plural nouns.

Unless otherwise noted, methods employed in the various embodiments and experimental examples are standard procedures. Furthermore, unless specified differently, materials and reagents used in various embodiments and experimental examples can be obtained from conventional biochemical reagent vendors.

According to an embodiment of the present invention, a method for recovering noble metals from a catalytic converter is provided, which comprises: (a) obtaining a catalytic converter, wherein the components of the catalytic converter comprise noble metals and base metals; (b) carrying out a high-temperature treatment on the catalytic converter to remove carbon-containing substances in the catalytic converter; (c) breaking the catalytic converter to obtain powder to be treated; (d) carrying out a liquid phase extraction on the powder to be treated, so as to dissolve the noble metals and the base metals in a liquid; (e) reacting and depositing the liquid to obtain a gold-containing precipitate, wherein the step (e) comprises performing the following steps in sequence: (e-1) adding metal hydroxide into the liquid to adjust the pH value of the liquid to 1-2; (e-2) adding sodium sulfite into the liquid; (e-3) standing the liquid to form a gold-containing precipitate; and (e-4) filtering the liquid to obtain a filtrate (I); (f) reacting and depositing the filtrate (I) to obtain a platinum-containing precipitate, wherein the step (f) comprises the following steps in sequence: (f-1) adding hydrogen peroxide into the filtrate (I); (f-2) adding potassium chloride into the filtrate (I); (f-3) standing the filtrate (I) to form a platinum-containing precipitate; and (f-4) filtering the filtrate (I) to obtain a filtrate (II); (g) reacting and depositing the filtrate (II) to obtain a base-metal-containing precipitate, wherein the step (g) comprises the following step in sequence: (g-1) adding $NH_4OH$ into the filtrate (II) to adjust the pH value of the filtrate (II) to 11; (g-2) standing the filtrate (II) to form a base-metal-containing precipitate; and (g-3) filtering the filtrate (II) to obtain a filtrate (iii); (h) reacting and depositing the filtrate (III) to obtain a palladium-containing metal precipitate, wherein the step (h) comprises the following steps in sequence: (h-1) adding HCl into the filtrate (III) to adjust the pH value of the filtrate (III) to less than 2; (h-2) standing the filtrate (III) to form a palladium-containing precipitate; and (h-3) filtering the filtrate (III) to obtain a filtrate (IV); and (i) reacting and depositing the filtrate (IV) to obtain a rhodium-containing metal precipitate, wherein the step (i) comprises the following steps in sequence: (i-1) repeatedly flowing the filtrate (IV) through Zn powder; (i-2) standing the filtrate (IV) to form a rhodium-containing precipitate; and (i-3) filtering the filtrate (IV) to obtain a filtrate (V), wherein the steps (e) to (i) are performed in sequence.

In this disclosure, the term "catalytic converter" refers to a device disposed in the exhaust system of automobiles or motorcycles, which contains noble metals such as platinum, palladium, and rhodium. During operation of a catalytic converter, these metals serve as catalysts, promoting chemical reactions that convert harmful exhaust gases like hydrocarbon (HC), carbon monoxide (CO), and nitrogen oxides (NOx) produced by the incomplete combustion of gasoline, thereby reducing the contents of these pollutants.

FIG. 1 presents a flowchart depicting a method for recovering noble metals from a catalytic converter in accordance with an embodiment of the present invention.

Figure 2:
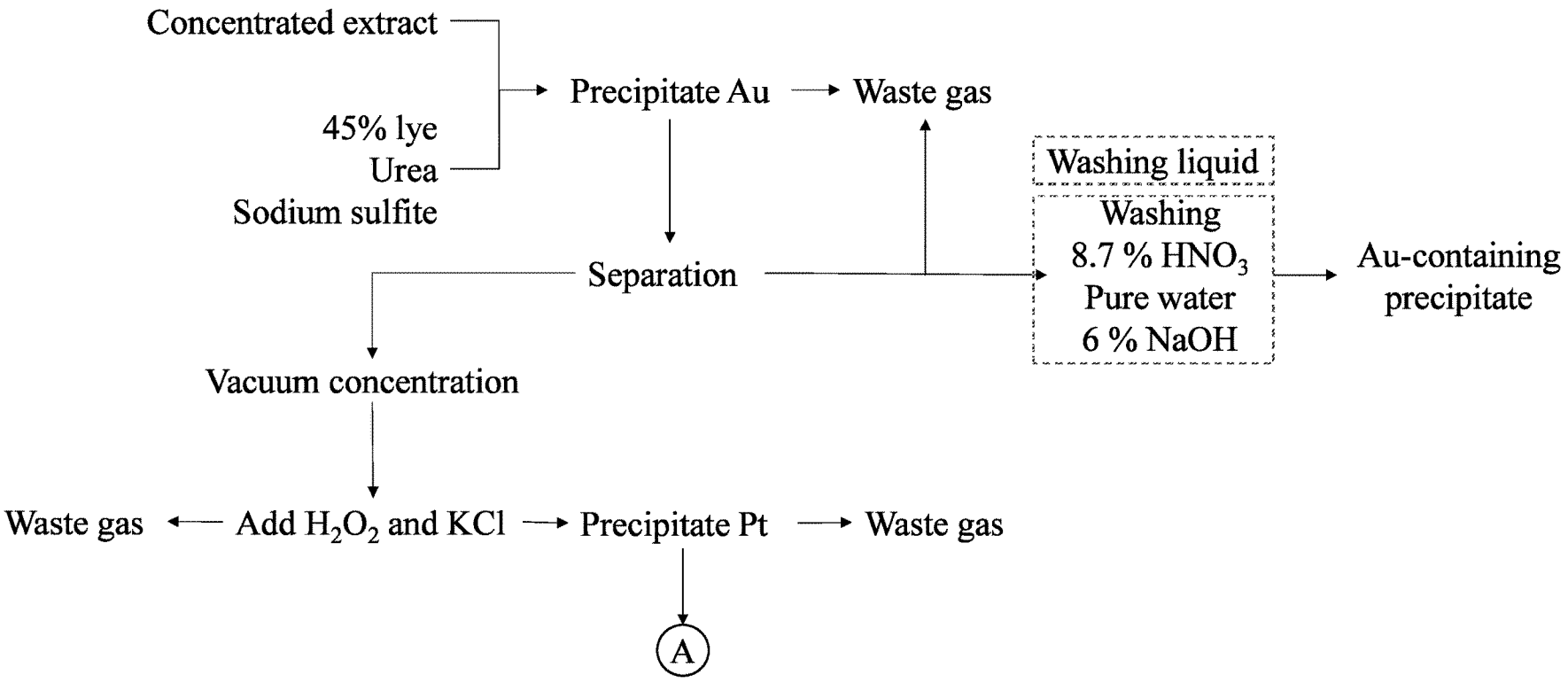
FIGS. 2 and 3 are flowcharts illustrating methods for recovering noble metals from a catalytic converter, according to another embodiment of the present invention.
Figure 3:
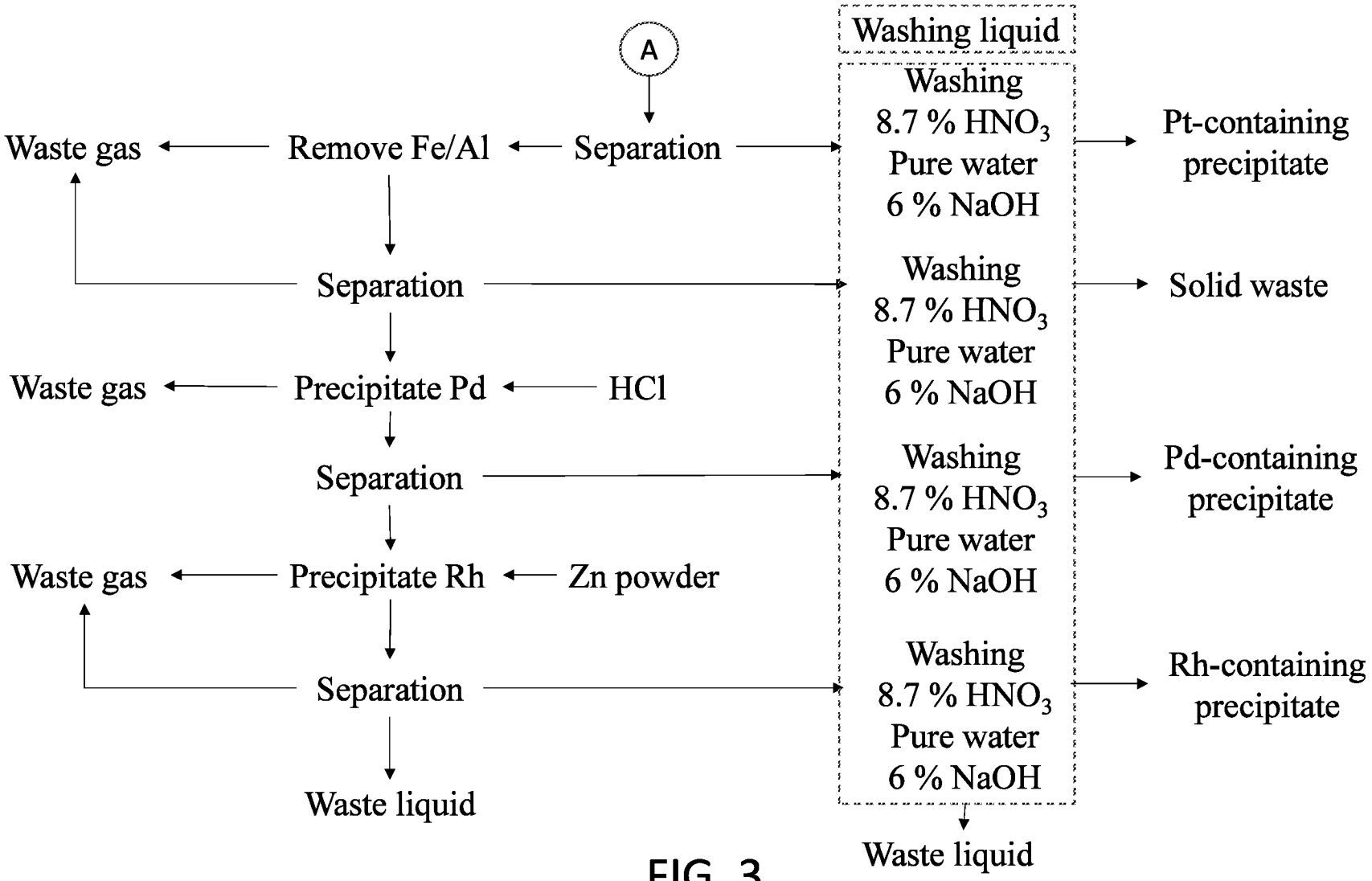

FIG. 2 and FIG. 3 are flowcharts of a method for recovering noble metals from a catalytic converter in accordance with another embodiment of the present invention. It should be noted that FIG. 2 and FIG. 3 are performed sequentially.

The subsequent descriptions set forth various embodiments of the present invention, providing sufficient details for those skilled in the art to employ the invention. It should be understood that the embodiments disclosed are merely exemplary and are not intended to limit the scope of the invention. That is, while specific materials, amounts and ratios of materials, and procedures are provided, these can be properly modified without departing from the scope of the present invention.

Step 1—Preparing Powder to be Treated

Referring to step 102 in FIG. 1. A regular automotive catalytic converter is obtained. The waste catalyst is washed by deionized water in a single stage to remove soluble impurities. Following filtration, the residues are dried in an oven at temperatures ranging from 80-90° C. overnight to yield a material. The constituents of this material comprise noble metals such as gold, platinum, palladium, and rhodium, as well as base metals such as iron and aluminum.

Subsequently, the dried material undergoes a high-temperature treatment for conducting carbonization to obtain a carbonized material. The temperature of the high-temperature treatment is 850° C., and the process time is 1 hour. Then, the carbonized material is cooled to 50° C. This cooled, carbonized material is then pulverized, for instance, by using a ball mill. The primary objective of the high-temperature treatment is to eliminate carbon and organic residues attached on the catalyst. Concurrently, the catalyst is reduced to finer particles for the forthcoming chemical leaching reaction. The carbonization phase may generate waste gases including organic VOCs, dust, and heat, which requires to be collected and then processed (through spraying and activated carbon). After processing with an induced draft fan to meet the standard, the waste gases are discharged to upper sky.

Step 2—Transfer the Metal in the Powder to be Treated to a Liquid.

Figure 4:
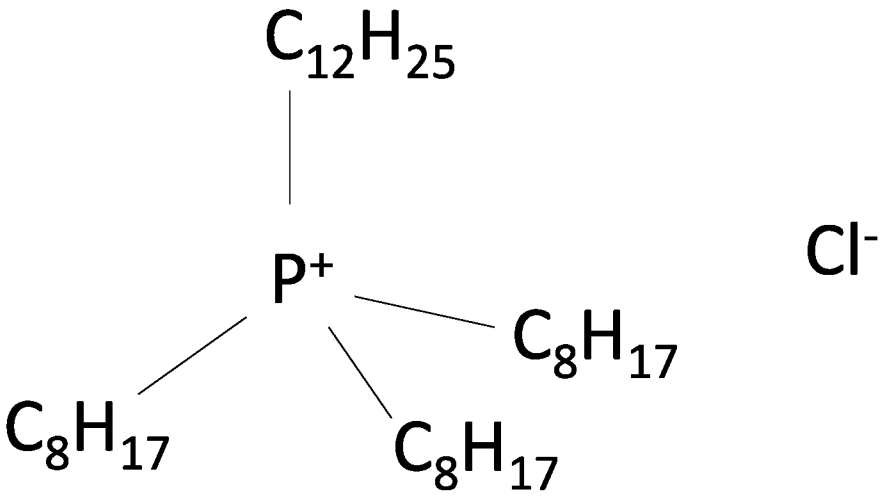
FIGS. 4 and 5 present chemical formulas of cations and anions from various ionic liquids.
Figure 5:
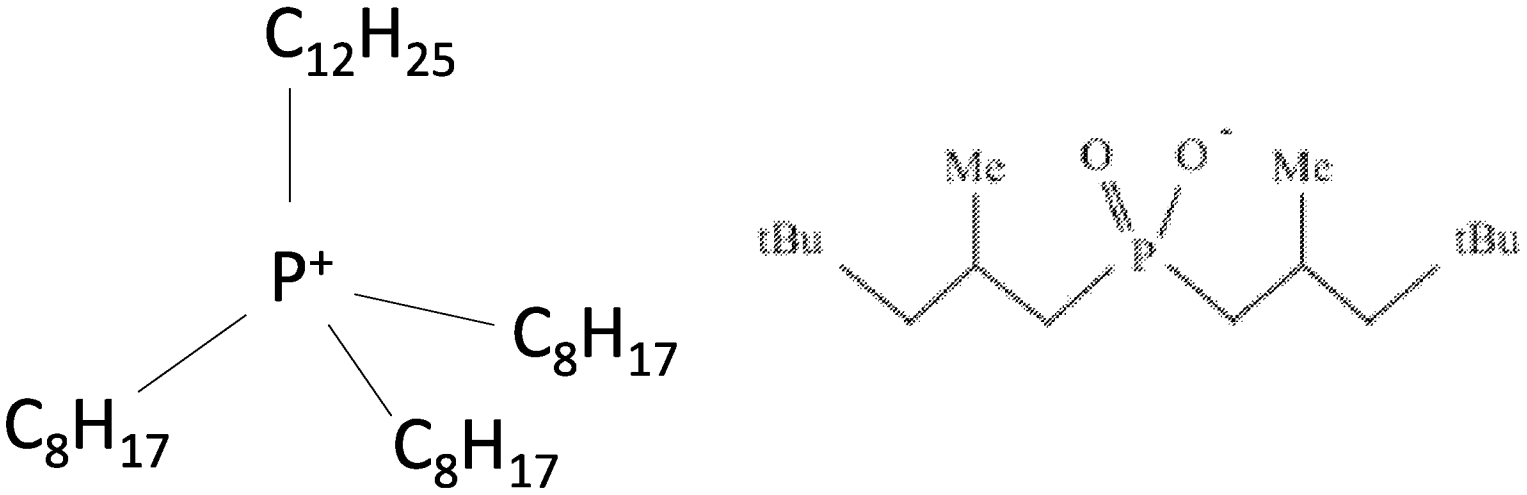

Referring to step 104 in FIG. 1, an ionic liquid (serving as a gold stripping agent) is combined with 68% nitric acid to obtain a mixed solution. In this mixed solution, the ratio of $HNO_3$ to ionic liquid is 1:1. Subsequently, the powder to be treated is blended with the mixed solution at a ratio of 1:10 (wt %). The mixture is then stirred as its temperature is elevated and maintained at 80° C., and the reaction is conducted for 2 hours. Then, the heat source is turned off and the liquid is cooled to 40° C. A centrifuge is employed to separate solid and liquid phases. After the liquid phase is filtered, it is transferred to a buffer tank for future use. The ionic liquid composition may be trioctyldodecyl phosphonium chloride ($P_{8,8,8,12}Cl$) as depicted in FIG. 4, or alternative ionic liquids such as $P_{8,8,8,12}R_2POO$ shown in FIG. 5. Ionic liquids can convert the metal within the powder to be treated into its ionic form, facilitating its dissolution in the ionic liquid. The term "ionic liquid" used in the specification denotes an organic salt compound which is composed of an asymmetric organic cation, and an inorganic or organic anion, and the melting point thereof is below 100° C.

At this stage, gold, platinum, palladium, rhodium, iron, and aluminum are present in the liquid phase as ions or salts. Examples include, but not limited to, gold (III), platinum (IV), palladium (II), rhodium (III), iron (III), and aluminum (III).

Step 3—Separating Gold (Au)

Referring to step 106 in FIG. 1, the step is shown as follows.

Reaction: The liquid in the extraction solution concentration tank is pumped into a gold precipitation tank. The mixer is set at 120 rpm. A 45% NaOH is slowly added, and the pH is modified to 1-2. Then, a specific amount of solid urea is slowly added, and the stirring is continued until the urea dissolution reaction is complete. Subsequently, sodium sulfite ($Na_2SO_3$) is added to produce fine Au particles. The total reaction time of these additions is 90 minutes.

Precipitation: The speed of stir is reduced to 30 rpm and the stirring is continued for an additional 30 minutes, allowing the fine Au particles to gradually grow. Then, the stirring is stopped, allowing the liquid to settle for 120 minutes to facilitate precipitation and separation.

Filtration: The bottom valve of the gold precipitation tank is opened and the speed is controlled. The mixed solution after gold precipitation is flown into a screening channel. This screening channel is positioned above the filter tank, which constantly applies negative pressure to expedite the filtration process. A liquid level controller is equipped in the filter tank, which controls the subsequent operation of the water pump, transferring the filtrate to the subsequent gold precipitation buffer tank for the subsequent platinum precipitation process. The filtration duration is set to be 90 minutes.

Washing: After filtration, the filtered gold precipitate is transferred to a washing tank. The structure of the washing tank is the same as that of the filtration tank. Pure water, dilute acid (e.g. 8.7% $HNO_3$), and dilute alkali (e.g. 6% NaOH) are used for washing in sequence, with negative pressure in the washing tank while washing. A liquid level controller is set in the washing tank, which controls the subsequent water pump to pump the washing liquid into a wastewater temporary storage tank for wastewater treatment. The washing lasts for 30 minutes.

The acidic waste gas generated during the gold precipitation reaction is gathered by a gas collection hood and directed to a waste gas treatment The solid is analyzed using inductively coupled plasma mass spectrometry (ICP-MS). Based on the total amount of metal, the gold content in the solid exceeds 80 wt. %.

The reaction formula of step 3 is shown as follows:

$$2HAuCl_4+3Na_2SO_3+3H_2O \rightarrow 2Au_{(s)}\downarrow+3Na_2SO_4+8HCl\uparrow$$

Step 4—Separating Platinum (Pt)

Referring to step 108 in FIG. 1, the step is shown as follows.

Evaporation concentration (also called vacuum concentration): The liquid in the gold precipitation buffer tank in above process is introduced to a gold precipitation concentration system. Upon the evaporation under negative pressure, nearly all the water is removed from the liquid, resulting in the residue as a viscous liquid. This viscous liquid subsequently is channeled into a post-gold precipitation concentrated solution buffer tank for subsequent treatment. The evaporated condensate is channeled into the water reuse system for recycling.

Reaction: The liquid contained in the post-gold precipitation concentrated solution buffer tank is pumped into a platinum precipitation tank. The mixer is set at 120 rpm, then an adequate volume of $H_2O_2$ is slowly added. Depending on the platinum concentration, a proper amount of KCl is proportionally added. The phenomenon of the reaction is monitored. A proper amount of KCl is added again to completely precipitate platinum. Fine solid particles of platinum precipitate ($K_2PtCl_6$) is rendered in the reaction. The duration of addition is 90 minutes. After the reaction is completed, procedures of precipitation, filtration, and washing are performed in sequence according to the procedure and duration of the gold precipitation above. After filtrate is pumped, a palladium precipitation system is ready for subsequent treatment. Both washing wastewater and acid waste gas are collected and treated.

The solid was analyzed by inductively coupled plasma mass spectrometry (ICP-MS). Based on the total amount of metal, the platinum content in the solid exceeds 25 wt. %.

The reaction formula of step 4 is shown as follows:

$$H_2PtCl_6+2KCl \rightarrow K_2PtCl_{6(s)}\downarrow+2HCl\uparrow$$

Step 5—Removing Fe/Al

Referring to step 110 in FIG. 1, the step is shown as follows.

Reaction: The filtered liquid after platinum precipitation in the above process is pumped into a solution purification tank. The mixer is set at 120 rpm and a proper amount of $NH_4OH$ (ammonium hydroxide) is gradually added to adjust the pH to approximately 11. The precipitated particles are formed during the purification. The duration of addition is 90 minutes.

Precipitation: The speed of stirring is decreased to 30 rpm. Then the stirring is continued for an additional 30 minutes, allowing the precipitated fine particles to grow slowly. The stirring is halted, and the liquid is settled for 120 minutes to achieve precipitation and separation. The composition of these particles are mainly $Fe(OH)_2$ and $Al(OH)_3$, but not limited thereto.

Filtration+Washing: The bottom valve is opened. The flow rate is controlled, allowing the precipitation mixture to be flown into the centrifuge. Through high-speed centrifugation, residue-liquid separation and on-line washing are achieved. The washed residue is combined to the residue derived from the above leaching reaction for solid waste processing. The washing solution is pumped into the palladium precipitation tank for palladium purification. The filtration and washing phase lasts 120 minutes.

Step 6—Separating Palladium (Pd)

Referring to step 112 in FIG. 1, the step is shown as follows.

Reaction: After removing the precipitate generated during purification in the above process, the filtrate is centrifuged and pumped into the palladium precipitation tank. The mixer is set at 120 rpm, and HCl is added gradually to adjust the pH to less than 2, allowing the formation of fine particles of $PdCl_2(NH_3)_2$. The duration of addition is 90 minutes.

After the reaction is completed, procedures of precipitation, filtration, and washing are performed in sequence according to the procedure and duration of the gold precipitation above. After filtrate is pumped, a rhodium precipitation system is ready for subsequent treatment. Both washing wastewater and acid waste gas are collected and treated.

The solid was analyzed by inductively coupled plasma mass spectrometry (ICP-MS). Based on the total amount of metal, the palladium content in the solid exceeds 80 wt. %.

The reaction formula of step 6 is shown as follows:

$$H_2PdCl_4+2NH_3\cdot H_2O \rightarrow PdCl_2(NH_3)_{2(s)}\downarrow+2H_2O+2HCl\uparrow$$

Step 7—Separating Rhodium (Rh)

Referring to step 114 in FIG. 1, the step is shown as follows.

Reaction: The obtained filtrate after palladium precipitation in above process is pumped into the rhodium precipitation tank. An open filter bag with Zn powder is hung at the center of the rhodium precipitation tank. The liquid circulation pump is turned on for drawing liquid from the bottom of the tank and the liquid is pumped into the filter bag. As the liquid passes through the Zn powder in the filter bag, and then goes back into the tank, a liquid circulation is achieved. During this liquid circulation phase, a substitution reaction of $HRhCl_4$ and Zn occurs, yielding fine rhodium particles. The duration of addition is 120 minutes.

Precipitation: The circulation is halted, allowing the fine rhodium particles to grow gradually. The liquid is settled for 120 minutes, allowing the precipitate to separate.

After the reaction is completed, procedures of precipitation, and washing are performed in sequence according to the procedure and duration of the gold precipitation above. After filtrate is pumped, it may be channeled to a chemical reuse temporary storage pool for reuse or be discarded to a waste treatment system. Both washing wastewater and acid waste gas are collected and treated.

After rhodium is recycled, the chemical liquid thereof is deemed as waste. When it is discarded, it is merged with the washing wastewater. They are underwent homogenization, and sent to the evaporation system. The resulting evaporation residue primarily consists of miscellaneous salts, which is disposed by hazardous waste treatment, while the evaporated condensate may either be reused or channeled to the wastewater treatment facility.

The solid was analyzed by inductively coupled plasma mass spectrometry (ICP-MS). Based on the total amount of metal, the rhodium content in the solid exceeds 80 wt. %.

The reaction formula of step 7 is shown as follows:

$$2HRhCl_4+4Zn \rightarrow 2Rh_{(s)}+4ZnCl_2+H_2\uparrow$$

Step 8—Manufacturing a Metal Ingot

Drying: The washed noble metal salts above are obtained from the screening system and are placed at corresponding trays respectively. These trays are placed at an 120° C. industrial oven for subsequent use. The waste gas generated during drying primarily consists of less water vapor without any characteristic pollutants, and it is collected and directly discharged.

High-frequency ingot manufacturing: The high-frequency waste gas generated in the high-frequency process is mainly an acid waste gas, which requires treatments for discharge. The term "high-frequency" denotes electromagnetic wave with frequency exceeding 100 kHz. Such waves utilize a high-frequency electromagnetic field to induce intense molecular collisions within materials, resulting an elevated temperature for welding and fusion. A high-frequency current is directed to a heating coil with ring shape or other shape (typically made of copper tube). This coil then emits a powerful magnetic beam exhibiting rapid polarity variation. When a metal or other object to be heated is placed within this coil, the magnetic beam penetrates the entire object to be heated. This interaction induces a significant eddy current within the object to be heated that the direction of the heating current is opposite from that of the eddy current. Because the interior of the object to be heated possesses resistance, it results in substantial Joule heat, thereby making the temperature of the object grows quickly. This process aims to heat all metal materials.

Step 9—Making Metal Catalyst 1 g of a spent car catalyst is extracted by acid, and is added to a 6 mL of $H_2PtCl_6$ (1%) solution. The mixture is stirred continuously at ambient temperature for 2 hours and then left undisturbed overnight. Subsequently, the solution is filtered by a Buchner filter, followed by triple washing with little deionized water. Then it is sent to a 120° coven for 12 hours drying. Afterward, the dried powder is underwent calcination at 300° C. for 6 hours. A platinum-containing metal product with mesopores is obtained, and the catalyst is represented as Pt-WSY.

The above description is only the preferred embodiment of the present invention, and all equivalent changes and modifications made according to the claims of the present invention should be included in the present invention.

What is claimed is:

1. A method for recovering noble metals from a catalytic converter, comprising:

(a) obtaining a catalytic converter, wherein the components of the catalytic converter comprise noble metals and base metals;

(b) performing a high-temperature treatment on the catalytic converter to remove carbon-containing substances in the catalytic converter;

(c) breaking the catalytic converter to obtain a powder to be treated;

(d) extracting the powder to be treated in liquid phase to make the noble metals and the base metals dissolve in a liquid;

(e) reacting and depositing the liquid to obtain a gold-containing precipitate, wherein step (e) comprises following steps in sequence:

(e-1) adding metal hydroxide into the liquid to adjust the pH value of the liquid to 1-2;

(e-2) adding sodium sulfite into the liquid;

(e-3) standing the liquid to form a gold-containing precipitate; and (e-4) filtering the liquid to obtain a filtrate (I);

(f) reacting and depositing the filtrate (I) to obtain a platinum-containing precipitate, wherein the step (f) comprises following steps in sequence:

(f-1) adding hydrogen peroxide into the filtrate (I);

(f-2) adding potassium chloride into the filtrate (I);

(f-3) standing the filtrate (I) to form a platinum-containing precipitate; and (f-4) filtering the filtrate (I) to obtain filtrate (II);

(g) reacting and depositing the filtrate (II) to obtain a base-metal-containing precipitate, wherein the step (g) comprises following steps in sequence:

(g-1) adding $NH_4OH$ into the filtrate (II) to adjust the pH value of the filtrate (II) to 11;

(g-2) standing the filtrate (II) to form the base-metal-containing precipitate; and (g-3) filtering the filtrate (II) to obtain filtrate (III);

(h) reacting and depositing the filtrate (III) to obtain a palladium-containing metal precipitate, wherein the step (h) comprises following steps in sequence:

(h-1) adding HCl to the filtrate (III) to adjust the pH value of the filtrate (III) to less than 2;

(h-2) standing the filtrate (III) to form a palladium-containing precipitate; and (h-3) filtering the filtrate (III) to obtain a filtrate (IV); and (i) reacting and depositing the filtrate (IV) to obtain a rhodium-containing metal precipitate, wherein the step (i) comprises following steps in sequence:

(i-1) repeatedly flowing the filtrate (IV) through Zn powder;

(i-2) standing the filtrate (IV) to form a rhodium-containing precipitate; and (i-3) filtering the filtrate (IV) to obtain a filtrate (V), wherein the step (e) to step (i) are performed in sequence.

2. The method for recovering noble metals from a catalytic converter according to claim 1, wherein the noble metals comprise gold, platinum, palladium and rhodium, and the base metals comprise iron and aluminum.

3. The method for recovering noble metals from a catalytic converter according to claim 1, wherein the metal hydroxide comprises sodium hydroxide.

4. The method for recovering noble metals from a catalytic converter according to claim 1, before step (f), further comprising concentrating the filtrate (I) under reduced pressure.

5. The method for recovering noble metals from a catalytic converter according to claim 1, wherein the platinum-containing precipitate comprises $K_2PtCl_6$.

6. The method for recovering noble metals from a catalytic converter according to claim 1, wherein the base-metal-containing precipitate comprises iron and aluminum.

7. The method for recovering noble metals from a catalytic converter according to claim 1, wherein the palladium-containing precipitate comprises $PdCl_2(NH_3)_2$.

8. The method for recovering noble metals from a catalytic converter according to claim 1, wherein in step (i-1), the filtrate (IV) comprises $HRhCl_4$.

9. A method for recovering noble metals from a catalytic converter, comprising:

(a) obtaining a catalytic converter, wherein the components of the catalytic converter comprise noble metals and base metals, wherein the noble metals comprise gold, platinum, palladium and rhodium, and the base metals comprise iron and aluminum;

(b) performing a high-temperature treatment on the catalytic converter to remove carbon-containing substances in the catalytic converter;

(c) breaking the catalytic converter to obtain a powder to be treated;

(d) extracting the powder to be treated in liquid phase to make the noble metals and the base metals dissolve in a liquid;

(e) reacting and depositing the liquid to obtain a gold-containing precipitate, wherein the step (e) comprises following steps in sequence:

(e-1) adding sodium hydroxide to the liquid to adjust the pH value of the liquid to 1-2;

(e-2) adding sodium sulfite into the liquid;

(e-3) standing the liquid to form a gold-containing precipitate;

(e-4) filtering the liquid to obtain a filtrate (I); and (e-5) concentrating the filtrate (I) under reduced pressure;

(f) reacting and depositing the filtrate (I) to obtain a platinum-containing precipitate, wherein the step (f) comprises following steps in sequence:

(f-1) adding hydrogen peroxide into the filtrate (I);

(f-2) adding potassium chloride into the filtrate (I);

(f-3) standing the filtrate (I) to form a platinum-containing precipitate, wherein the platinum-containing precipitate comprises $K_2PtCl_6$; and (f-4) filtering the filtrate (I) to obtain a filtrate (II);

(g) reacting and depositing the filtrate (II) to obtain a base-metal-containing precipitate, wherein the step (g) comprises following steps in sequence:

(g-1) adding $NH_4OH$ into the filtrate (II) to adjust the pH value of the filtrate (II) to 11;

(g-2) standing the filtrate (II) to form a base-metal-containing precipitate, wherein the base-metal-containing precipitate comprises iron and aluminum; and (g-3) filtering the filtrate (II) to obtain a filtrate (III);

(h) reacting and depositing the filtrate (III) to obtain a palladium-containing metal precipitate, wherein the step (h) comprises following steps in sequence:

(h-1) adding HCl to the filtrate (III) to adjust the pH value of the filtrate (III) to less than 2;

(h-2) standing the filtrate (III) to form a palladium-containing precipitate, wherein the palladium-containing precipitate comprises $PdCl_2(NH_3)_2$; and (h-3) filtering the filtrate (III) to obtain a filtrate (IV), wherein the filtrate (IV) contains $HRhCl_4$; and (i) reacting and depositing the filtrate (IV) to obtain a rhodium-containing metal precipitate, wherein the step (I) comprises following steps in sequence:

(i-1) repeatedly flowing the filtrate (IV) through Zn powder;

(i-2) standing the filtrate (IV) to form a rhodium-containing precipitate; and (i-3) filtering the filtrate (IV) to obtain a filtrate (V), wherein the step (e) to step (i) are performed in sequence.

* * * * *